US009134062B2

(12) United States Patent
Jung et al.

(10) Patent No.: US 9,134,062 B2
(45) Date of Patent: Sep. 15, 2015

(54) REFRIGERATOR

(71) Applicant: LG Electronics Inc., Seoul (KR)

(72) Inventors: Yongki Jung, Gyeongsangnam-do (KR); Jinhong Park, Gyeongsangnam-do (KR); Munjae Jang, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/091,564

(22) Filed: Nov. 27, 2013

(65) Prior Publication Data

US 2014/0159560 A1 Jun. 12, 2014

(30) Foreign Application Priority Data

Dec. 10, 2012 (KR) ..... 10-2012-0142557
Dec. 10, 2012 (KR) ..... 10-2012-0142558
Jan. 18, 2013 (KR) ..... 10-2013-0005815

(51) Int. Cl.
*A47B 96/04* (2006.01)
*F25D 23/02* (2006.01)

(52) U.S. Cl.
CPC ..... *F25D 23/028* (2013.01); *F25D 23/02* (2013.01); *F25D 2323/021* (2013.01)

(58) Field of Classification Search
CPC .. F25D 23/028; F25D 23/069; E05D 11/1064
USPC ..... 16/256, 257, 326–328, 330, 379; 312/326, 329, 405, 407; 49/303, 316, 49/320, 321
See application file for complete search history.

(56) References Cited

U.S. PATENT DOCUMENTS

| | | | | |
|---|---|---|---|---|
| 5,411,328 | A * | 5/1995 | You | 312/405 |
| 6,917,824 | B2 * | 7/2005 | Kobayashi | 455/575.3 |
| 7,008,032 | B2 * | 3/2006 | Chekal et al. | 312/405 |
| 7,726,756 | B2 * | 6/2010 | Fu | 312/405 |
| 8,167,389 | B2 * | 5/2012 | Han et al. | 312/405 |
| 8,292,383 | B2 * | 10/2012 | Laible | 312/405 |
| 2007/0257589 | A1 * | 11/2007 | Laible | 312/405 |
| 2009/0235488 | A1 * | 9/2009 | Chien | 16/327 |

* cited by examiner

*Primary Examiner* — Matthew Ing
(74) *Attorney, Agent, or Firm* — Fish & Richardson P.C.

(57) ABSTRACT

A refrigerator includes a main body having a storage compartment, first and second doors opening or closing the storage compartment, and a pillar configured to block cool air from leaking between the first and second doors. The refrigerator also includes a hinge that rotatably connects the pillar to the first door and a holder disposed on the storage compartment and configured to guide rotation of the pillar. The hinge includes a rotation shaft that enables the pillar to rotate with respect to the first door and a rotation restriction unit that is configured to contact the holder and, based on the contact with the holder, move the rotation shaft in a direction parallel to an extension direction of the rotation shaft. The rotation restriction unit selectively restricts the rotation of the pillar with respect to the first door.

17 Claims, 13 Drawing Sheets

REFRIGERATOR

CROSS-REFERENCE TO RELATED APPLICATIONS

The present application claims priority under 35 U.S.C. 119 and 35 U.S.C. 365 to Korean Patent Application No. 10-2012-0142557 (filed on Dec. 10, 2012), Korean Patent Application No. 10-2012-0142558 (filed on Dec. 10, 2012), and Korean Patent Application No. 10-2013-0005815 (filed on Jan. 18, 2013), which are all hereby incorporated by reference in their entirety.

BACKGROUND

Refrigerators are electric appliances for storing foods at a low temperature. A refrigerator may include a refrigerating compartment and a freezing compartment provided under the refrigerating compartment. Also, the refrigerator may include a plurality of refrigerating compartment doors for opening/closing the refrigerating compartment and a freezing compartment door for opening/closing the freezing compartment.

The plurality of refrigerating compartment doors may be horizontally disposed to independently open or close the refrigerating compartment. The plurality of refrigerating compartment doors may include a first refrigerating compartment door and a second refrigerating compartment door disposed at a left side of the first refrigerating compartment door.

A pillar may be rotatably disposed on the first refrigerating compartment door to prevent cool air within the refrigerating compartment from leaking between the refrigerating compartment doors when each of the refrigerating compartment doors closes the refrigerating compartment.

The pillar may be spread while the pillar is inserted into a holder provided in the refrigerating compartment when the first refrigerating compartment door is closed and be folded while the pillar is withdrawn from the holder when the first refrigerating compartment door is opened.

SUMMARY

In one aspect, a refrigerator includes a main body having a storage compartment, first and second doors configured to open or close the storage compartment, and a pillar configured to block cool air from leaking between the first and second doors. The refrigerator also includes a hinge that rotatably connects the pillar to the first door and a holder disposed on the storage compartment and configured to guide rotation of the pillar. The hinge includes a rotation shaft that enables the pillar to rotate with respect to the first door and a rotation restriction unit that is configured to contact the holder and, based on the contact with the holder, move the rotation shaft in a direction parallel to an extension direction of the rotation shaft. The rotation restriction unit selectively restricts the rotation of the pillar with respect to the first door.

Implementations may include one or more of the following features. For example, the rotation restriction unit may include a locking device configured to restrict the pillar from rotating and maintain the pillar in a folded state based on the first door being oriented in an opened position and an unlocking device configured to release the locking of the locking device and allow the pillar to rotate to a spread state based on the first door being closed. In this example, the hinge may include a hinge body coupled to the first door, the rotation shaft may be connected to the hinge body, and the locking device may restrict the hinge body and the rotation shaft from rotating with respect to each other.

In some implementations, the locking device may include a first locking part disposed on the rotation shaft and a second locking part disposed on the hinge body. In these implementations, the hinge body may include a coupling part coupled to the first door and a shaft connection part disposed within the pillar and through which the rotation shaft passes. The second locking part may be disposed on the shaft connection part.

In some examples, one of the first and second locking parts may include a locking projection and another of the first and second locking parts may include a projection groove configured to receive the locking projection. In these examples, based on the rotation shaft moving downward, the locking projection may be configured to withdraw from the projection groove, thereby enabling rotation of the pillar.

Further, the locking projection may be a first locking projection, the projection groove may be a first projection groove, the first locking part may include the first locking projection, and the second locking part may include the first projection groove. In addition, the second locking part may include a second locking projection and the second locking part may include a second projection groove configured to receive the second locking projection.

Also, one of the first and second locking parts may include a projection, and another of the first and second locking parts may include a projection groove configured to receive the projection. The refrigerator further may include an elastic member that elastically supports the first locking part in a manner that maintains a locked state of the first and second locking parts.

In some implementations, the first locking part may protrude from the rotation shaft in a radius direction and may be accommodated in the second locking part. In these implementations, the second locking part may include a hole through which the first locking part passes or a groove in which the first locking part is accommodated.

In some examples, the second locking part may include a first accommodation part that restricts rotation of the first locking part and a second accommodation part that enables rotation of the first locking part. In these examples, the first accommodation part may extend in a direction parallel to the extension direction of the rotation shaft and the second accommodation part may extend in a direction crossing the extension direction of the rotation shaft. Further, in these examples, the refrigerator may include an elastic member that provides elastic force to the unlocking device to retain the first locking part in the first accommodation part.

In some implementations, the unlocking device may include an operator disposed within the pillar and configured to move in a direction that presses the rotation shaft and a push part disposed on the holder and configured to press the operator based on the first door being closed. In these implementations, the operator may be separated from or integrated with the rotation shaft. In addition, the refrigerator may include an elastic member that elastically supports the operator.

In some examples, the operator may include a protrusion that protrudes outside of the pillar and a press part that extends from the protrusion and that presses the rotation shaft. In these examples, the protrusion may include a tilted surface, the holder may include an accommodation space configured to accommodate the protrusion, and the push part may be disposed in the accommodation space. Further, in these examples, the accommodation space may include a first accommodation space in which the protrusion is accommodated based on the first door being open and a second accommodation space bent from the first accommodation space, the protrusion may be accommodated into the second accommodation space via the first accommodation space based on the first door being closed, and, in a state in which the protrusion is disposed in the first accommodation space, the operator may press the rotation shaft to release the locking of the locking device.

In another aspect, a refrigerator includes a main body having a refrigerating compartment and a freezing compartment disposed under the refrigerating compartment, first and second refrigerating compartment doors configured to open or close the refrigerating compartment, and a freezing compartment door configured to open or close the freezing compartment. The refrigerator also includes a hinge body connected to the first refrigerating compartment door and a pillar connected to the hinge body. The refrigerator further includes a locking device configured to restrict the pillar from rotating and maintain the pillar in a folded state based on the first door being oriented in an opened position and an unlocking device configured to release the locking of the locking device and allow the pillar to rotate to a spread state based on the first door being closed.

The details of one or more implementations are set forth in the accompanying drawings and the description below. Other features will be apparent from the description and drawings, and from the claims.

DETAILED DESCRIPTION

Figure 1:
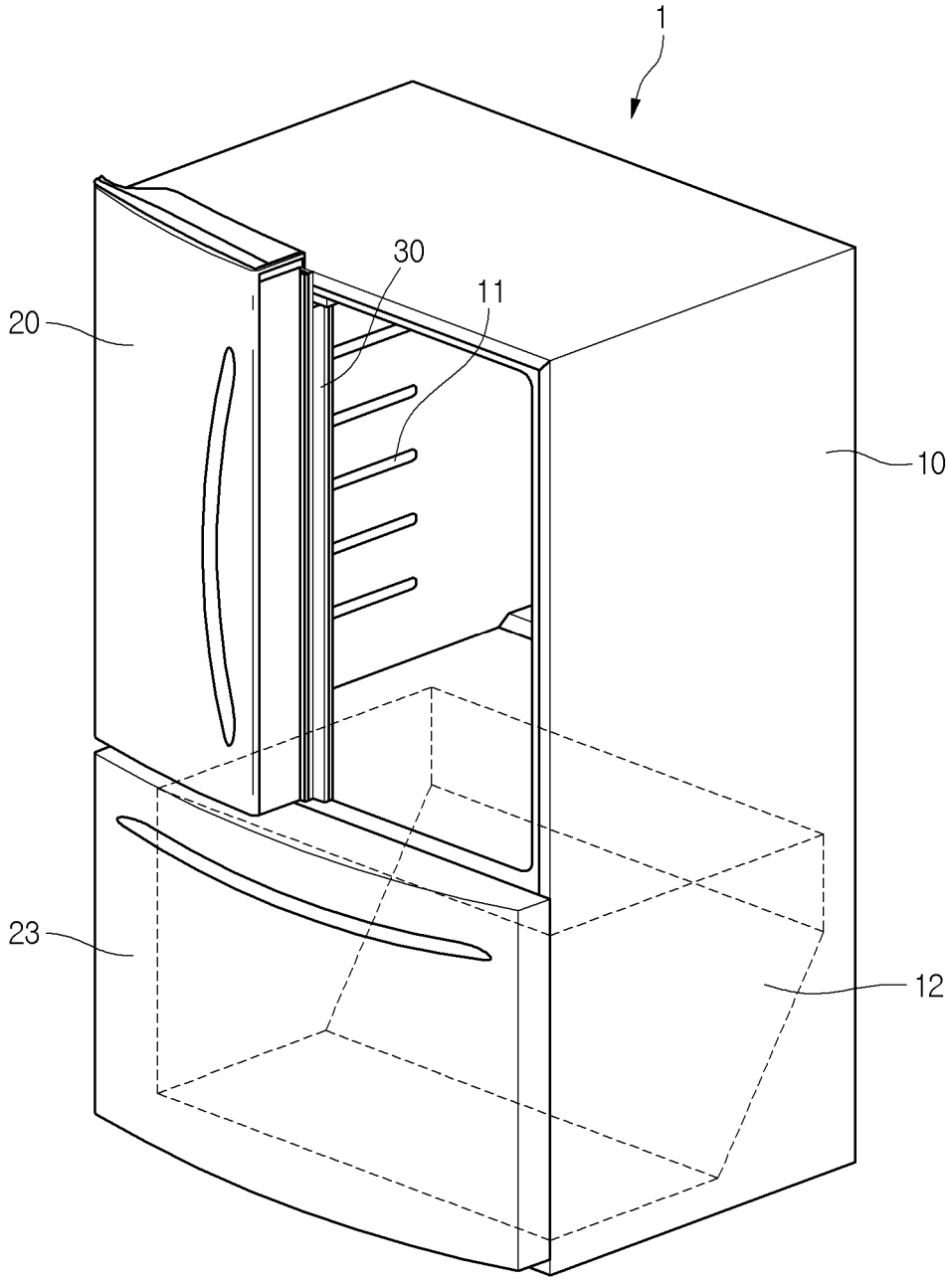
FIG. 1 is a perspective view of an example refrigerator.
Figure 2:
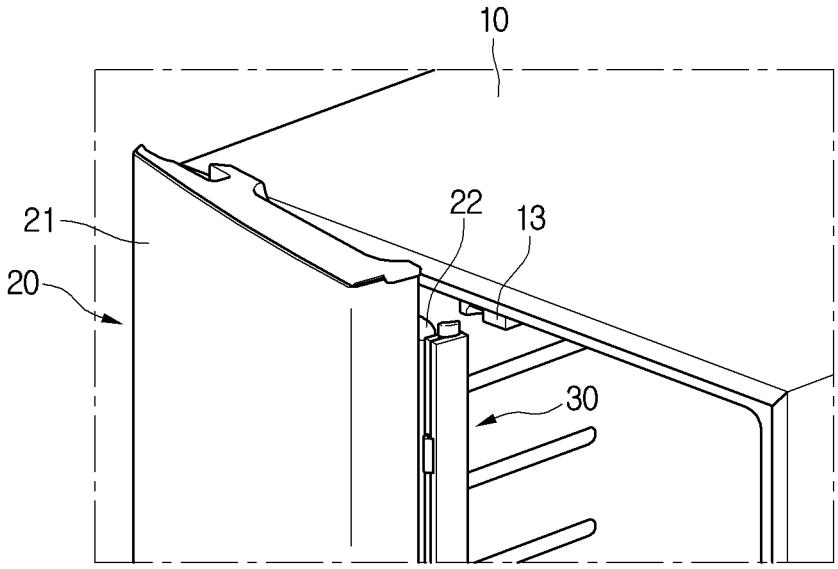
FIG. 2 is a partial perspective view of the example refrigerator with a first refrigerating compartment door opened.

FIG. 1 illustrates an example refrigerator, and FIG. 2 is a partial perspective view of the example refrigerator with a first refrigerating compartment door opened.

For illustrative purposes, FIGS. 1 and 2 illustrate an example of a state in which a second refrigerating compartment door is removed.

Referring to FIGS. 1 and 2, a refrigerator 1 may include a main body 10 having a refrigerating compartment 11 and a freezing compartment 12, a plurality of refrigerating compartment doors rotatably connected to the main body 10 by using a hinge assembly to open or close the refrigerating compartment 11, and a freezing compartment door 23 for opening or closing the freezing compartment 12.

The plurality of refrigerating compartment doors may include a first refrigerating compartment door 20 rotatably connected to a left portion of the main body 10 and a second refrigerating compartment door (shown as removed for better illustrative purposes) rotatably connected to a right portion of the main body 10. That is, in this example, the first refrigerating compartment door 20 and the second refrigerating compartment door may be disposed on left and right sides, respectively. In some cases, the plurality of refrigerating compartment doors may further include at least one door in addition to the two doors.

The freezing compartment door 23 may open or close the freezing compartment 12 by using, for example, a sliding manner. That is, the freezing compartment door may be, for example, a drawer type door. Alternatively, the freezing compartment door 23 may be rotatably coupled to the main body 10.

A pillar 30 may be provided on one of the first refrigerating compartment door 20 and the second refrigerating compartment door. The pillar 30 may reduce leakage of cool air within the refrigerating compartment 11 between the plurality of refrigerating compartment doors when the plurality of refrigerating compartment doors are closed.

FIG. 1 illustrates an example of a state in which the pillar 30 is disposed on the first refrigerating compartment door 20.

As shown in FIG. 2, the first refrigerating compartment door 20 may include an outer case 21 and a door liner 22 connected to the outer case 21. The pillar 30 may be rotatably connected to the door liner 22.

A holder 13 in which an upper end of the pillar 30 is accommodated may be disposed on the refrigerating compartment 11. For example, the holder 13 may be disposed on an upper wall of the refrigerating compartment 11. In another example, the holder 13 may be disposed on a lower wall of the refrigerating compartment 11, and a lower end of the pillar 30 may be accommodated in the holder 13. If the first refrigerating compartment door 20 rotates upward or downward about a horizontal hinge shaft, the pillar 30 may be disposed on a wall of the refrigerating compartment 11.

When the first refrigerating compartment door 20 is closed, the pillar 30 may spread by interaction with the holder 13. Thus, the pillar 30 may block a gap between the plurality of refrigerating compartment doors and, thus, block air from exiting the refrigerating compartment 20 through the gap. That is, the holder 13 may guide the pillar 30 to allow the pillar 30 to rotate.

On the other hand, when the first refrigerating compartment door 20 is opened, the pillar 30 is folded by the interaction with the holder 13.

The state of the pillar 30 illustrated in FIG. 1 may be referred to as a state in which the pillar 30 is spread, and the state of the pillar 30 illustrated in FIG. 2 may be referred to as a state in which the pillar 30 is folded.

In the example shown in FIGS. 1 and 2, when the pillar 30 is folded, the rotation of the pillar 30 is restricted (e.g., prevented) by a locking device (described in more detail below), and thus the pillar 30 is not spread until the first refrigerating compartment door 20 is closed.

Figure 3:
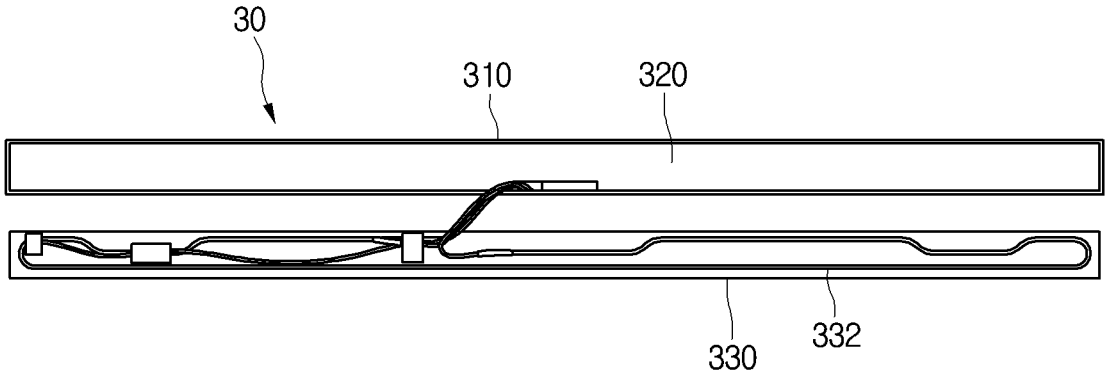
FIG. 3 is a view of an example pillar in a state in which an example pillar cover is separated from an example pillar body.
Figure 4:
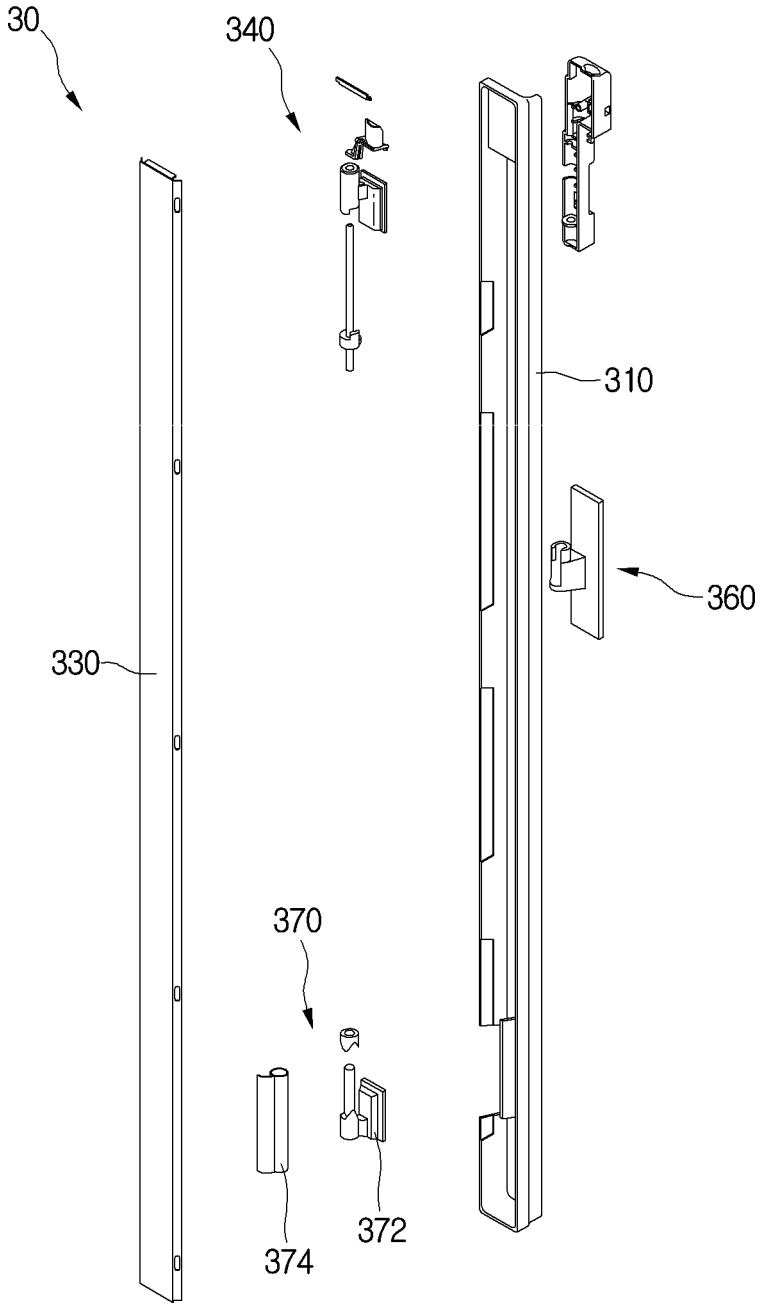
FIG. 4 is an exploded perspective view of the example pillar.
Figure 5:
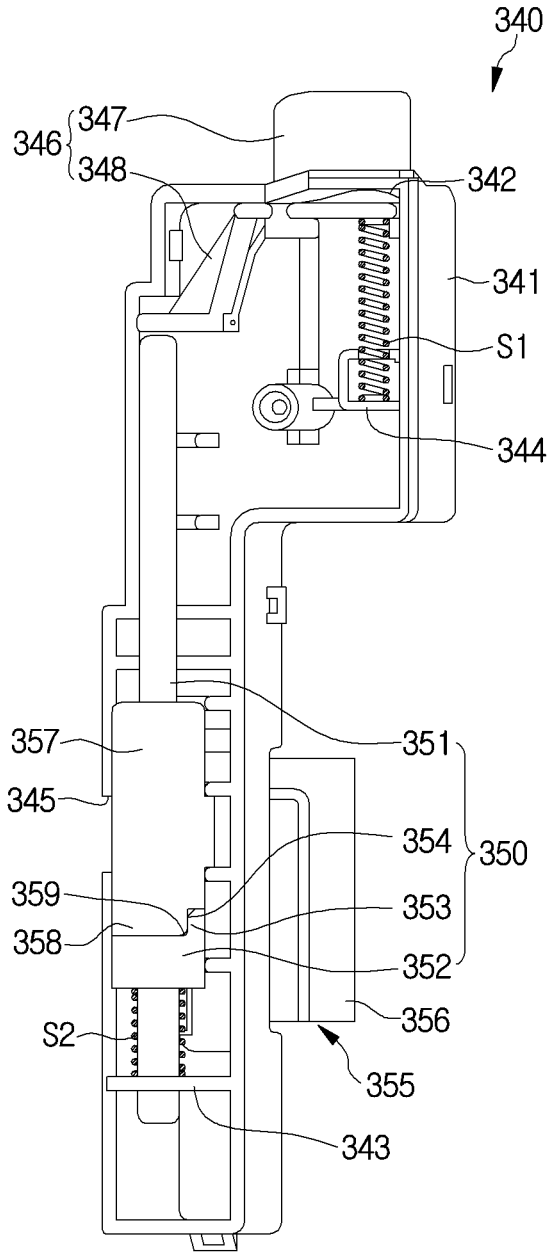
FIG. 5 is a view of an example first hinge assembly.

FIG. 3 illustrates a state of an example pillar in which an example pillar cover is separated from an example pillar body, FIG. 4 is an exploded perspective view of the example pillar, and FIG. 5 illustrates an example first hinge assembly. FIG. 5 illustrates the first hinge assembly in a state where the first refrigerating compartment door is opened.

Referring to FIGS. 3 to 5, the pillar 30 may include a pillar body 310 and a pillar cover 330 coupled to the pillar body 310.

The pillar 30 may further include an insulation material 320 accommodated in the pillar body 310. A heater 332 for reducing (e.g., preventing) accumulation of frost on the pillar 30 may be disposed in the pillar cover 330. Thus, in a state where the pillar cover 330 is coupled to the pillar body 310, the heater 332 may contact the insulation material 320.

In this example, when the first refrigerating compartment door 20 is closed, the heater 332 is disposed between the insulation material 320 and the pillar cover 330. Thus, the insulation material 320 blocks heat generated in the heater 332 from being transmitted into the refrigerating compartment 11.

Also, the pillar 30 may further include a plurality of hinge assembles 340, 360, and 370. The plurality of hinge assembles 340, 360, and 370 may include a first hinge assembly 340 disposed on an upper portion of the pillar 30, a second hinge assembly 360 disposed on a middle portion of the pillar 30, and a third hinge assembly 370 disposed on a lower portion of the pillar 30. Although the pillar 30 includes the three hinge assembles in this example, the pillar 30 may include more or fewer hinge assemblies. For smooth rotation of the pillar 30, a plurality of hinge assemblies may be used. For example, the hinge assembles may be disposed on the upper and lower portions of the pillar, respectively.

The third hinge assembly 370 may include a hinge body 372 and a hinge cover 374. A portion of the hinge body 372 may be coupled to the door liner 22. Also, the hinge body 372 includes a hinge shaft. Further, in a state where the hinge shaft is seated on the pillar body 310, the hinge cover 374 covers the hinge shaft.

A wire connected to the heater 332 may be withdrawn to the outside through the second hinge assembly 360.

The first hinge assembly 340 (hereinafter, referred to at times as a "hinge") may include a hinge body 355, a rotation shaft 350 rotatably connected to the hinge body 355, and an operator 346 for moving the rotation shaft 350. The rotation shaft 350 may rotate about the hinge body 355 together with the pillar 30.

The hinge body 355 may include a coupling part 356 coupled to the door liner 22 and a shaft connection part 357 to which the rotation shaft 350 is connected. The coupling part 356 may be coupled to a side surface of the door liner 22.

The first hinge assembly 340 may further include the rotation shaft 350 and an installation part 341 on which the operator 346 is installed. For example, the installation part 341 may be coupled to the pillar body 310. In another example, the installation part 341 may be integrated with the pillar body 310.

An opening 345 through which a connection portion between the shaft connection part 357 and the coupling part 356 passes may be defined in the installation part 341.

A portion of the operator 346 may protrude outward from the installation part 341 in a state where the operator 346 is seated on the installation part 341. Also, the operator 346 may move by external force. That is, the operator 346 may be movably disposed on the pillar 30.

The operator 346 may include a protrusion 347 accommodated in the holder 13 and a press part 348 extending downward from the protrusion 347.

The rotation shaft 350 may be disposed under the press part 348, and the press part 348 may selectively press the rotation shaft 350 downward. The rotation shaft 350 may move downward by the compression of the press part 348.

The protrusion 347 may be elastically supported by a first elastic member S1. The first elastic member S1 supports the protrusion 347 in a direction in which the protrusion 347 protrudes from the installation part 341. For example, the first elastic member S1 supports the protrusion 347 upward at a lower side of the protrusion 347. For example, the first elastic member S1 may be a coil spring. However, the first elastic member S1 is not limited to a coil spring that supports the protrusion 347. For example, the first elastic member S1 may elastically support the press part 348 and/or may be another type of elastic member.

The installation part 341 may include a hole 342 through which the protrusion 347 passes and a first support 344 for supporting the first elastic member S1.

The rotation shaft 350 may pass through the shaft connection part 357. The rotation shaft 350 may include a shaft body 351 passing through the shaft connection part 357. Thus, the rotation shaft 350 and the hinge body 355 may rotate with respect to each other.

The first hinge assembly 340 may further include a locking device for restricting (e.g., preventing) the rotation shaft 350 and the hinge body 355 from rotating with respect to each other in the state where the first refrigerating compartment 20 is opened.

The locking device may include a first locking part 352 protruding from the shaft body 351 and a second locking part 358 interacting with the first locking part 352 and disposed on the shaft connection part 357.

The locking part 352 may have a diameter greater than that of the shaft body 351. The first locking part 352 may protrude from an entire circumference of the shaft body 351 or radially protrude from a portion of the shaft body 351. The first locking part 352 may include a locking projection 353, and the second locking part 358 may include a locking groove 359. The locking projection 353 may have a first contact surface 354 contacting the locking groove 359 in a state where the locking projection 353 is inserted into the locking groove 359. Also, the locking groove 359 may have a second contact surface contacting the first contact surface 354. Each of the contact surfaces 354 may be a vertical surface, a tilted surface, or a rounded surface.

The first locking part 352 may be elastically supported by a second elastic member S2. A support 343 for supporting the second elastic member S2 may be disposed on the installation part 341. Here, the rotation shaft 350 may pass through the support 343 to guide the rotation of the rotation shaft 350.

The second elastic member S2 elastically supports the first locking part 352 in a direction in which the locking projection 353 is inserted into the locking groove 358. For example, the second elastic member S2 may support the first locking part 352 upward at a lower side of the first locking part 352. For example, the second elastic member S2 may be a coil spring. However, the second elastic member S2 is not limited to a coil spring and may include another type of elastic member.

In this example, the rotation shaft 350 extends vertically. Thus, the rotation shaft 350 may rotate with respect to the hinge body 355 in a horizontal direction.

To restrict (e.g., prevent) the rotation shaft 350 and the hinge body 355 from rotating in the horizontal direction, the locking projection 353 may vertically move together with the rotation shaft 350 and thus be inserted into the locking groove 359 or withdrawn from the locking groove 359.

Although the first locking part 352 includes the locking projection 353, and the second locking part 358 includes the locking groove 359 in the illustrated example, the first locking part 352 may include the locking groove 359, and the second locking part 358 may include the locking projection 353.

Alternatively, the first locking part 352 may be one of the locking projection and the locking groove, and the second locking part 358 may be the other one of the locking projection and the locking groove.

Figure 6:
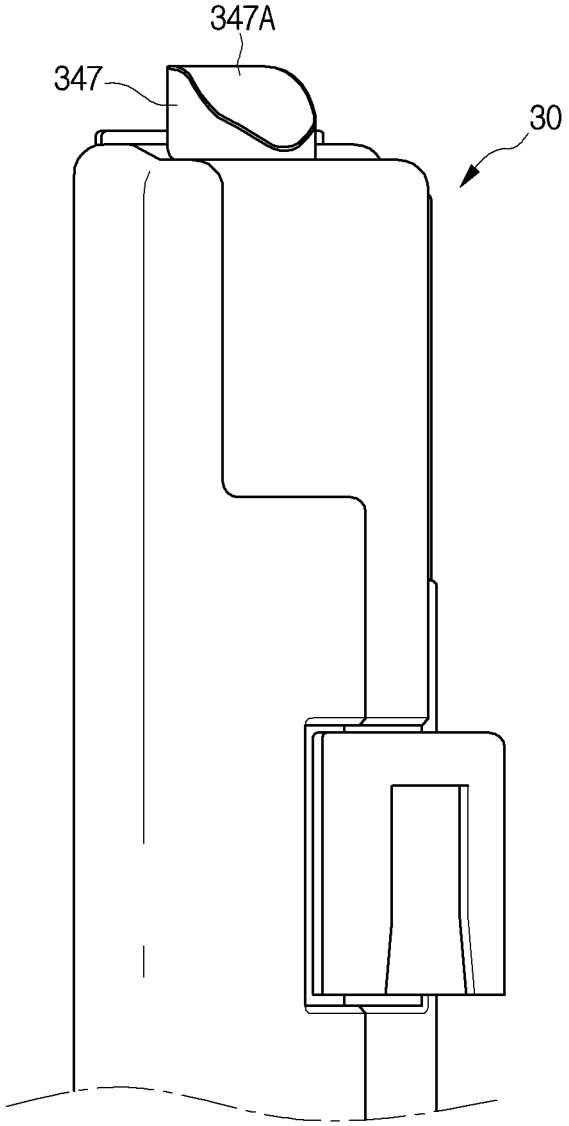
FIG. 6 is a partial perspective view illustrating an upper portion of the example pillar.
Figure 7:
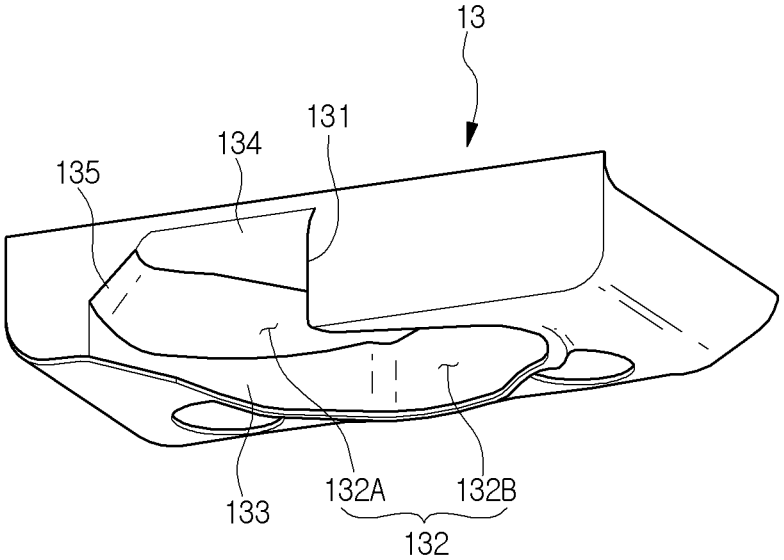
FIG. 7 is a perspective view of an example holder.

FIG. 6 illustrates an upper portion of the example pillar, and FIG. 7 illustrates an example holder.

Referring to FIGS. 6 and 7, the protrusion 347 of the operator 346 may have a tilted surface 347A. Thus, the protrusion 347 may have a thickness gradually increasing upward.

The holder 13 may have an opening 131 through which the protrusion 347 passes and an accommodation space 132 for accommodating the protrusion 347 passing through the opening 131. The accommodation space 132 may include a first accommodation space 132A extending in parallel with the insertion direction of the protrusion 347 and a second accommodation space 132B bent from the first accommodation space 132A to change the moving direction of the protrusion 347.

The accommodation space 132 may include a side surface 133, a top surface 134, and a connection surface 135 connecting the side surface 133 to the top surface 134. Also, the connection surface 135 may contact the tilted surface 347A of the protrusion 347. The connection surface 135 of the accommodation space 132 may be a substantially tilted surface as a protruding surface in the accommodation space 132. That is, the side surface 133 and the top surface 134 may be connected to each other by the connection surface 135 that protrudes in the accommodation space 132 without the side surface 133 being directly connected to the top surface 134. Also, the connection surface 135 of the accommodation space 132 may press the protrusion 347 downward while the protrusion 347 is accommodated into the accommodation space 132. Thus, in this example, the connection surface 135 may be called a push part that presses the protrusion 347.

Hereinafter, an operation of the pillar when the first refrigerating compartment door is opened will be described.

Figure 8:
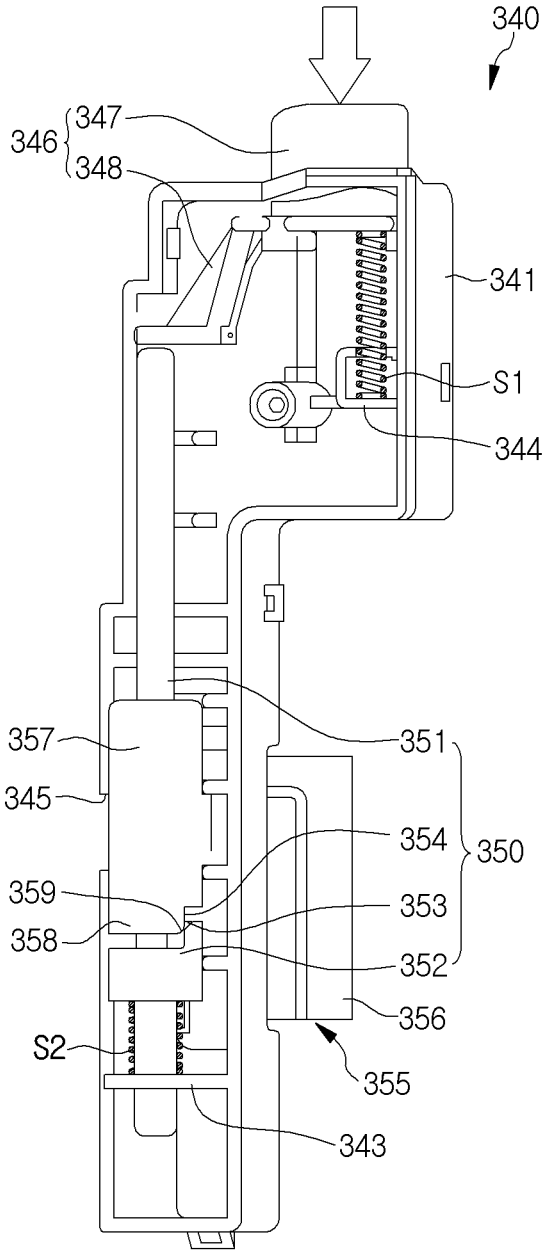
FIG. 8 is a view of a state before the example first hinge assembly is unlocked.
Figure 9:
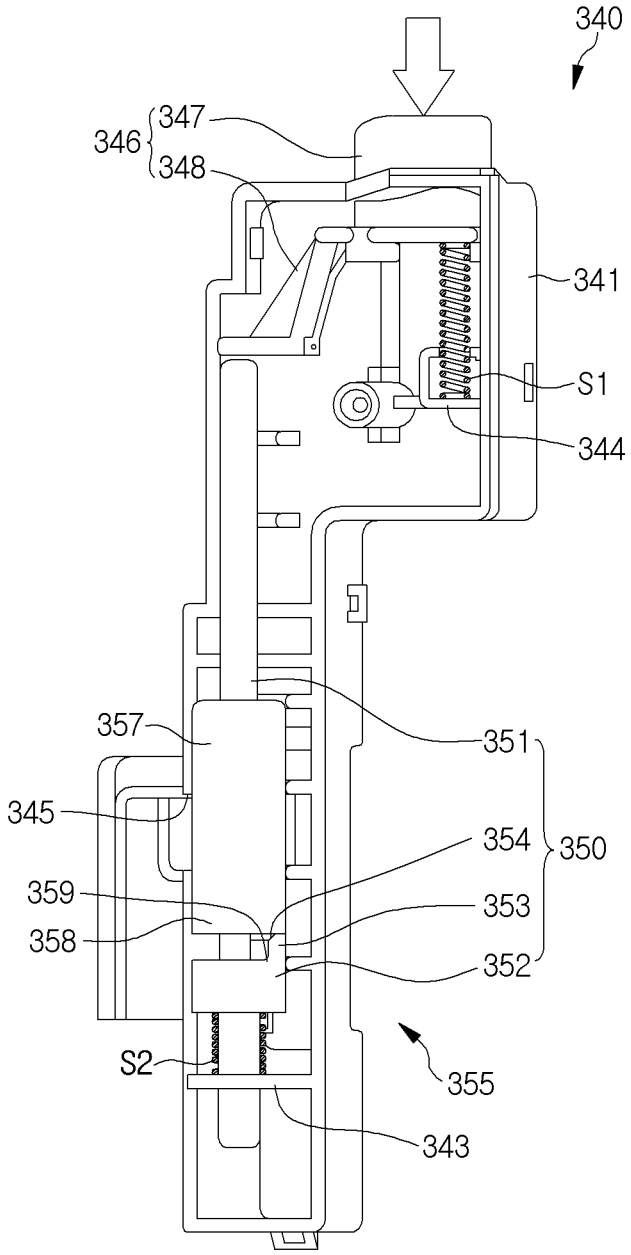
FIG. 9 is a view of a state in which the example first hinge assembly is unlocked.

FIG. 8 illustrates a state before the first hinge assembly is unlocked, and FIG. 9 illustrates a state in which the first hinge assembly is unlocked.

First, referring to FIGS. 2 and 5, external force is not applied to the operator 346 in the state where the first refrigerating compartment door 20 is opened.

Thus, the protrusion 347 of the operator 346 may be maintained in the state protruding upward from the pillar 30 by the elastic force of the first elastic member S1, and the first locking part 352 may be supported by the second elastic member S2. Accordingly, the first and second locking parts 352 and 358 may be locked. That is, the first hinge assembly 340 is locked by the locking device. As described above, in the state where the first hinge assembly 340 is locked, the pillar may be maintained in the folded state as shown in FIG. 2. The pillar 30 does not rotate unless downward pressing force is applied to the operator 346. That is, the pillar 30 may be maintained in the folded state.

In this state, when the first refrigerating compartment door 20 rotates and then is closed, the pillar 30 may rotate together with the first refrigerating compartment door 20 in the folded state. While the first refrigerating compartment door 20 is closed, the protrusion 347 of the operator 346 is inserted into the first accommodation space 132A through the opening 131 of the holder 13. Here, the highest point of the protrusion 347 when the insertion of the protrusion 347 into the first accommodation space 132A starts is disposed between the side surface 133 and the top surface 134 of the accommodation space 132.

Thus, when the protrusion 347 is initially inserted into the first accommodation space 132A, the push part of the accommodation space 132 may contact the tilted surface 347A of the protrusion 347 to press the protrusion 347 downward as shown in FIG. 8.

Thus, when the protrusion 347 is pressed downward, the first elastic member S1 is contracted and the press part 348 presses the rotation shaft 350 to move the rotation shaft 350 downward. That is, the rotation shaft 350 may move in a direction in which the locking projection 353 of the first locking part 352 is withdrawn from the locking groove 359 of the second locking part 358. With this movement, the second elastic member S2 is contracted.

Then, when the protrusion 347 is continuously inserted into the first accommodation space 132A, the protrusion 347 and the rotation shaft 350 may further move downward. Thus, as shown in FIG. 9, the locking projection 353 of the first locking part 352 may be completely withdrawn from the locking groove 359 to release the locking of the locking device.

Here, in this example, the locking of the locking device may be released in a state where the protrusion 347 is disposed in the first accommodation space 132A.

The protrusion 347 has to be changed in moving direction so as to move the protrusion 347 from the first accommodation space 132A to the second accommodation space 132B. To change the moving direction of the protrusion 347, the locking of the locking device may be released to enable the rotation shaft 350 to rotate. Thus, in this example, the locking of the locking device may be released in a state where the protrusion 347 is completely inserted into the first accommodation space 132A or before the protrusion 347 is completely inserted into the first accommodation space 132A. However, even though the locking of the locking device is released, the pillar 30 does not rotate before the protrusion 347 moves into the second accommodation space 132B. When the protrusion is accommodated in the first accommodation space 132A, the pillar 30 may be maintained in the folded state.

When the locking of the locking device is released, the rotation shaft 350 and the hinge body 355 may rotate with respect to each other. Also, while the protrusion 347 moves into the second accommodation space 132B, rotation force may be applied to the protrusion 347. Because the hinge body 355 is fixed to the first refrigerating compartment door 20, the pillar 30 may rotate together with the rotation of the rotation shaft 350. Also, when the protrusion 347 is completely inserted into the second accommodation space 132B, the pillar may be completely spread. The locking device may be maintained in the unlocked state in the state where the protrusion 347 is completely accommodated into the second accommodation space 132B.

Since the operator 346 and the push part of the holder 13 release the locking of the locking device, the operator 346 and the push part may be called an unlocking device. Also, the locking device and the unlocking device may be called a rotation restriction unit for selectively restricting the rotation of the pillar (or the rotation shaft).

When the first refrigerating compartment door 20 rotates to open the first refrigerating compartment door 20, the protrusion 347 may move from the second accommodation part 132B to the first accommodation space 132A and then be withdrawn from the first accommodation space 132A. Here, the locked state of the locking device may be maintained in the state where the protrusion 347 is disposed in the second accommodation space 132B. Also, the locking device may be locked while the protrusion 347 is withdrawn from the first accommodation space 132A in the state where the protrusion 347 moves to the first accommodation space 132A.

While the protrusion 347 moves from the second accommodation space 132B to the first accommodation space 132A, the pillar 30 may be folded. In addition, when the protrusion 347 moves from the second accommodation space 132B to the first accommodation space 132A, the locking device may change to a lockable state. Also, when the protrusion 347 is completely withdrawn from the first accommodation space 132A, the locking device may be locked in the state where the pillar 30 is folded.

According to this example, the pillar is folded while the first refrigerating compartment door is opened. Since the rotation of the pillar is restricted (e.g., prevented) by the locking device in the state where the pillar is folded, it may prevent the first refrigerating compartment door from being closed in the state where the pillar is folded.

Also, since the folded state of the pillar is maintained in the state where the first refrigerating compartment door is opened, a user may close the first refrigerating compartment door even though the second refrigerating compartment door is closed.

Also, since the locking device is automatically locked or unlocked while the first refrigerating compartment door is opened or closed, it may be unnecessary to separately manipulate the locking device by the user.

Although the push part has been described as being disposed in the accommodation space 132, the push part may be disposed outside the holder 13. In this case, the protrusion 347 may be pressed by the push part before the protrusion 347 is inserted into the accommodation space of the holder 13 to release the locked state of the locking device.

Also, although the pillar has been described as including the first and second elastic members, one of the first and second elastic members may be omitted.

Further, although the operator and the rotation shaft are separately provided, the operator and the rotation shaft may be integrated with each other.

Although the pillar has been described as being disposed on the first refrigerating compartment door, the pillar may be disposed on the second refrigerating compartment door. In addition, the pillar also may be used on one of a plurality of freezing compartment doors for opening or closing the freezing compartment. Thus, the refrigerating compartment and the freezing compartment may be called a storage compartment, and doors for opening or closing the storage compartment may be called first and second doors.

Figure 10:
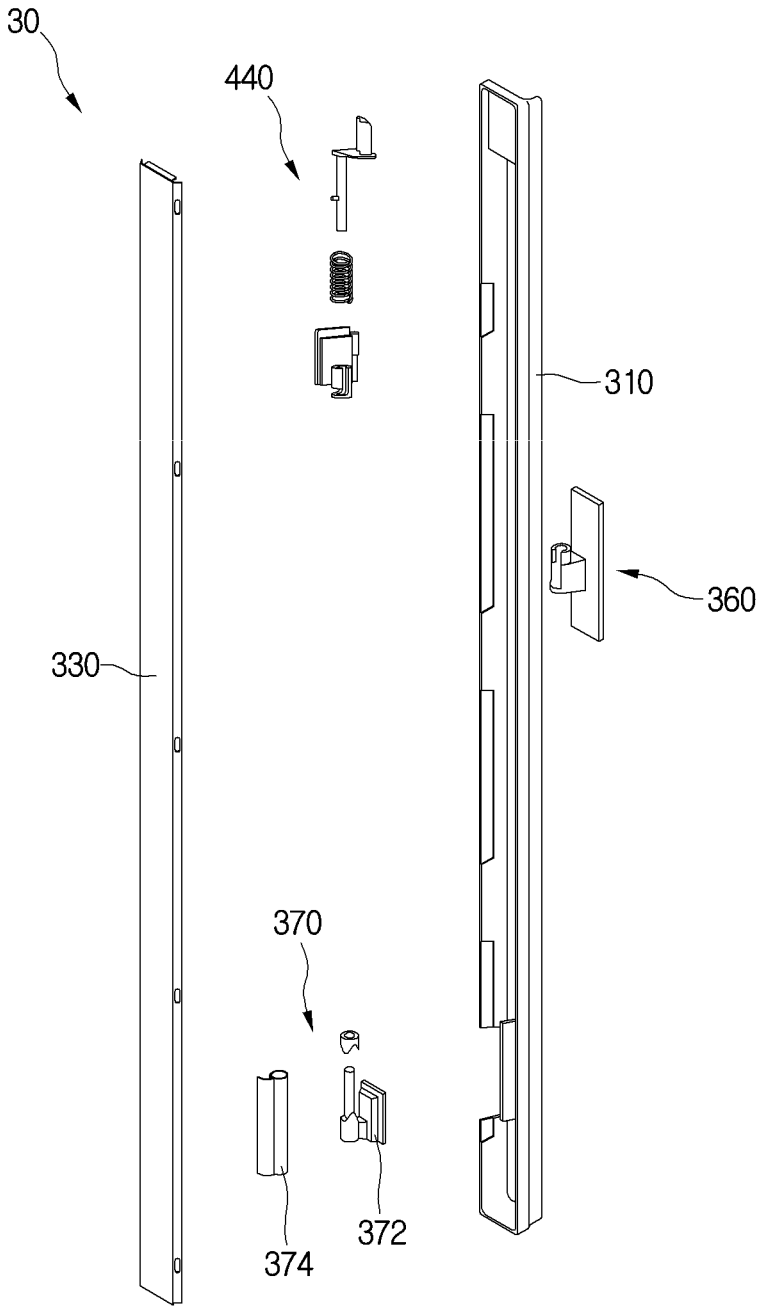
FIG. 10 is an exploded perspective view of another example pillar according to another embodiment.
Figure 11:
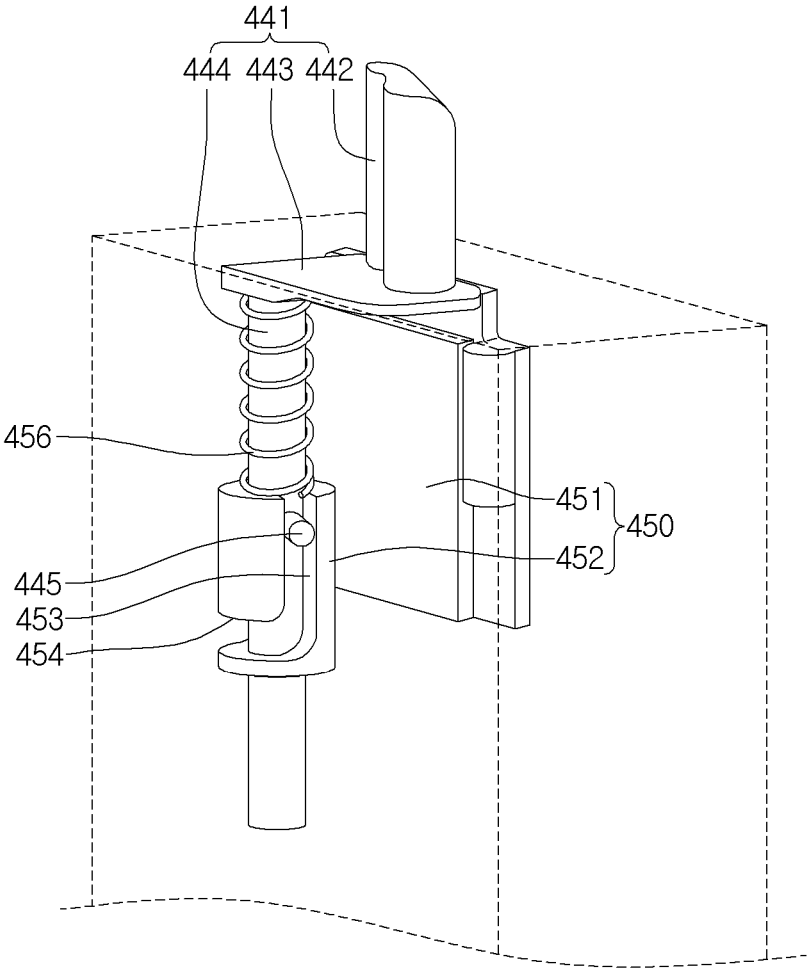
FIG. 11 is a view of another example first hinge assembly.

FIG. 10 illustrates another example pillar, and FIG. 11 illustrates another example first hinge assembly. FIG. 11 illustrates a first hinge assembly in a state where a first refrigerating compartment door is opened.

The example shown in FIGS. 10 and 11 is the same as the example shown in FIGS. 4 and 5 except for a first hinge assembly. Thus, the above description of the same parts is referenced, rather than repeated.

Referring to FIGS. 10 and 11, a pillar 30 may include a pillar body 310 and a pillar cover 330 coupled to the pillar body 310.

Also, the pillar 30 may include a plurality of hinge assembles 440, 360, and 370. The plurality of hinge assembles 440, 360, and 370 may include a first hinge assembly 440 disposed on an upper portion of the pillar 30, a second hinge assembly 360 disposed on a middle portion of the pillar 30, and a third hinge assembly 370 disposed on a lower portion of the pillar 30.

The first hinge assembly 440 (hereinafter, referred to at times as a "hinge") may include a hinge body 450 and an operator 441 rotatably connected to the hinge body 450.

The operator 441 may include a protrusion 442 protruding to a side of the pillar 30, e.g., upward from the pillar 30, an extension part 443 extending from the protrusion 442, and a rotation shaft 444 extending downward from the extension part 443 to provide a rotational center of the pillar 30. The rotation shaft 444 may be integrated with the extension part 443 or be coupled to a lower portion of the extension part 443.

In another example, the operator 441 may include the protrusion 442 and a rotation shaft 444 extending downward from the protrusion 442. In yet another example, the operator 441 includes the protrusion 442, and the rotation shaft 444 may be separated from the operator.

The hinge body 450 may include a coupling part 451 coupled to a door liner 22 and a shaft connection part 452 connected to the rotation shaft 444 of the operator 441. The coupling part 451 may be coupled to a side surface of the door liner 22.

The rotation shaft 444 may pass through the shaft connection part 452. Thus, the rotation shaft 444 and the hinge body 450 may rotate with respect to each other.

The first hinge assembly 440 may further include a locking device for restricting (e.g., preventing) the rotation shaft 444 and the hinge body 450 from rotating with respect to each other in a state where the first refrigerating compartment 20 is opened.

The locking device may include a first locking part 445 disposed on the rotation shaft 444 and second locking parts 453 and 454 interacting with the first locking part 445 and disposed on the shaft connection part 452.

The first locking part 445 may be a protrusion protruding from the rotation shaft 444 in a radius direction. The first locking part 445 may be integrated with the rotation shaft 444 or coupled to the rotation shaft 444.

The second locking parts 453 and 454 may include a first accommodation part 453 extending from the shaft connection part 452 in a direction parallel to the extension direction of the rotation shaft 444, e.g., a vertical direction and a second accommodation part 454 extending from a lower end of the first accommodation part 453 in a direction crossing the extension direction of the rotation shaft 444, e.g., a horizontal direction. Here, the second accommodation part 454 may be defined along a circumference of the shaft connection part 452 and thus rounded.

Each of the first and second accommodation parts 453 and 454 may be a hole through which the first locking part 445 passes in a state where the rotation shaft 444 is connected to the shaft connection part 452.

Also, the first locking part 445 may move along the second locking parts 453 and 454 in a state where the first locking part is accommodated in the second locking parts 453 and 454.

In another example, each of the second locking parts 453 and 454 may be a groove in which the first locking part 445 is accommodated. That is, each of the second locking parts 453 and 454 may be a groove in which an inner circumferential surface of the shaft connection part 452 is recessed outward. Also, the second locking parts 453 and 454 may include a first accommodation part extending vertically and a second accommodation part extending from a lower end of the first accommodation part in a horizontal direction.

In this example, the opening or the guide groove may be called an accommodation part.

In addition, each of the second locking parts 453 and 454 may be limited to a shape thereof.

The operator 441 may be elastically supported by an elastic member 456. The elastic member 456 may support the operator 441 in a direction in which the protrusion 442 protrudes from the pillar 30. For example, the elastic member 456 may support the operator 441 upward from a lower side of the operator 441. In this example, the elastic member 456 may be a coil spring. However, the elastic member 456 is not limited to a coil spring that supports the operator 441. For example, the elastic member 456 may support the rotation shaft 444 and/or may include another type of elastic member.

For example, the elastic member 456 may support a lower portion of the extension part 443. Here, the elastic member 456 may surround the rotation shaft 444, and a lower end of the elastic member 456 may be supported by an upper portion of the shaft connection part 452.

In this example, the rotation shaft 444 extends vertically. Thus, the rotation shaft 444 may rotate with respect to the hinge body 450 in a horizontal direction.

The relative rotation of the rotation shaft 444 and the hinge body 450 in the horizontal direction may be restricted (e.g., prevented) in a state where the rotation shaft 444 is disposed in the first accommodation part 453. In a state where the rotation shaft 444 is disposed in the second accommodation part 454, the relative rotation of the rotation shaft 444 and the hinge body 450 in the horizontal direction may be enabled. Here, the elastic member 456 may act so that the first locking part 445 is disposed in the first accommodation part 453 when the first refrigerating compartment door is open.

Figure 12:
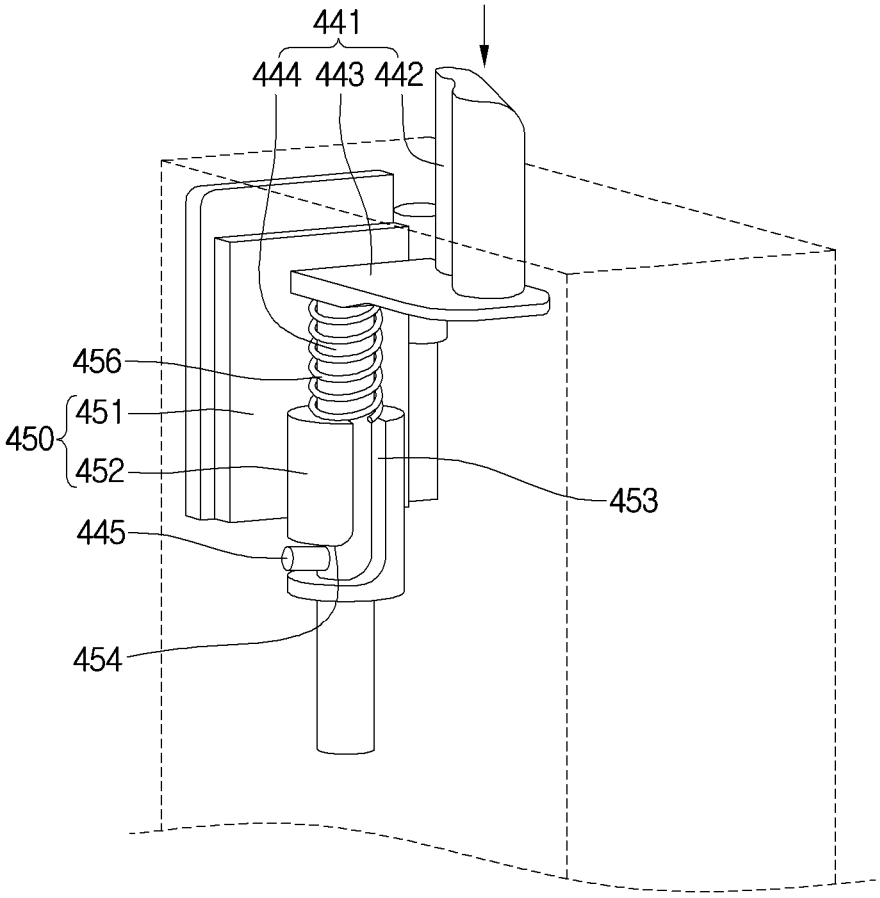
FIG. 12 is a view of a state in which the example first hinge assembly is unlocked according to another embodiment.

FIG. 12 illustrates a state in which the first hinge assembly is unlocked.

Referring to FIGS. 2, 7, 11, and 12, external force is not applied to the operator 441 in a state where the first refrigerating compartment door 20 is opened.

Thus, the protrusion 442 of the operator 441 may be maintained in the state in which the protrusion 442 protrudes upward from the pillar 30 by elastic force of the elastic member 456, and the first locking member 445 may be disposed in the first accommodation part 453. Accordingly, the first locking part 445 and the second locking part may be locked.

That is, the first hinge assembly 440 is locked by the locking device. As described above, in the state where the first hinge assembly 440 is locked, the pillar 30 may be maintained in the folded state as shown in FIG. 2. The pillar 30 does not rotate unless downward pressing force is applied to the operator 441. That is, the pillar 30 may be maintained in the folded state.

In this state, when the first refrigerating compartment door 20 rotates and then is closed, the pillar 30 may rotate together with the first refrigerating compartment door 20 in the folded state. While the first refrigerating compartment door 20 is closed, the protrusion 441 of the operator 442 is inserted into the first accommodation space 132A through the opening 131 of the holder 13. Here, the highest point of the protrusion 442 when the insertion of the protrusion 442 into the first accommodation space 132A starts is disposed between the side surface 133 and the top surface 134 of the accommodation space 132.

Thus, when the protrusion 442 is initially inserted into the first accommodation space 132A, the push part of the accommodation space 132 may contact a tilted surface 347A of the protrusion 442 to press the protrusion 442 downward as shown in FIG. 12.

When the protrusion 442 is pressed downward, the elastic member 456 is contracted. Thus, the first locking part 445 may move downward along the first accommodation part 453.

Then, when the protrusion 442 is inserted further into the first accommodation space 132A, the protrusion 442 and the rotation shaft 444 may further move downward. Accordingly, the first locking part 445 may move from the first accommodation part 453 to the second accommodation part 454 to release the locking of the locking device.

In this example, the locking of the locking device may be released in a state where the protrusion 442 is disposed in the first accommodation space 132A.

The protrusion 442 is changed in moving direction so as to move the protrusion 442 from the first accommodation space 132A to the second accommodation space 132B. To change the moving direction of the protrusion 442, the locking of the locking device may be released to enable the rotation shaft 444 to rotate. Thus, in this example, the locking of the locking device may be released in a state where the protrusion 442 is completely inserted into the first accommodation space 132A or before the protrusion 442 is completely inserted into the first accommodation space 132A. Even though the locking of the locking device is released, the pillar 30 does not rotate before the protrusion 442 moves into the second accommodation space 132B. Thus, the pillar 30 may be maintained in the folded state.

When the locking of the locking device is released, the rotation shaft 444 and the hinge body 450 may rotate with respect to each other. Also, while the protrusion 442 moves into the second accommodation space 132B, rotation force may be applied to the protrusion 442. Since the hinge body 450 is fixed to the first refrigerating compartment door 20, the first locking part 445 may move along the second accommodation part 454 together with the rotation of the rotation shaft 444, and thus, the pillar 30 may rotate. Also, when the protrusion 442 is completely inserted in the second accommodation space 132B, the pillar 30 may be completely spread. The locking device may be maintained in the unlocked state in the state where the protrusion 442 is completely accommodated in the second accommodation space 132B.

Since the operator 446 and the push part of the holder 13 release the locking of the locking device, the operator 446 and the push part may be called an unlocking device. Also, the locking device and the unlocking device may be called a rotation restriction unit for selectively restricting the rotation of the pillar (or the rotation shaft).

When the first refrigerating compartment door 20 rotates to open the first refrigerating compartment door 20, the protrusion 442 may move from the second accommodation space 132B to the first accommodation space 132A and then be withdrawn from the first accommodation space 132A. Here, the locked state of the locking device may be returned in the state where the protrusion 442 is disposed in the second accommodation space 132B. Also, the locking device may be locked while the protrusion 442 is withdrawn from the first accommodation space 132A in the state where the protrusion 442 moves to the first accommodation space 132A.

While the protrusion 442 moves from the second accommodation space 132B to the first accommodation space 132A, the pillar 30 may be folded. Also, when the protrusion 442 moves from the second accommodation space 132B to the first accommodation space 132A, the locking device may return to a locked state. Further, when the protrusion 442 is completely withdrawn from the first accommodation space 132A, the locking device may be locked in the state where the pillar 30 is folded.

Figure 13:
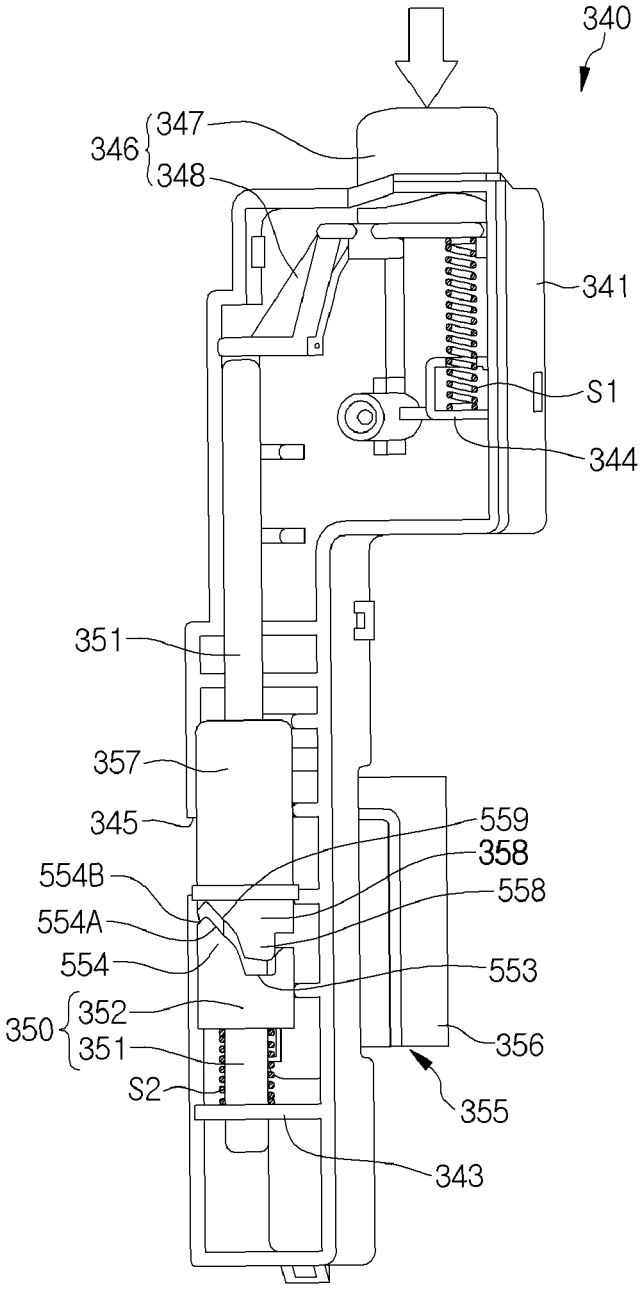
FIG. 13 is a view of yet another example first hinge assembly.
Figure 14:
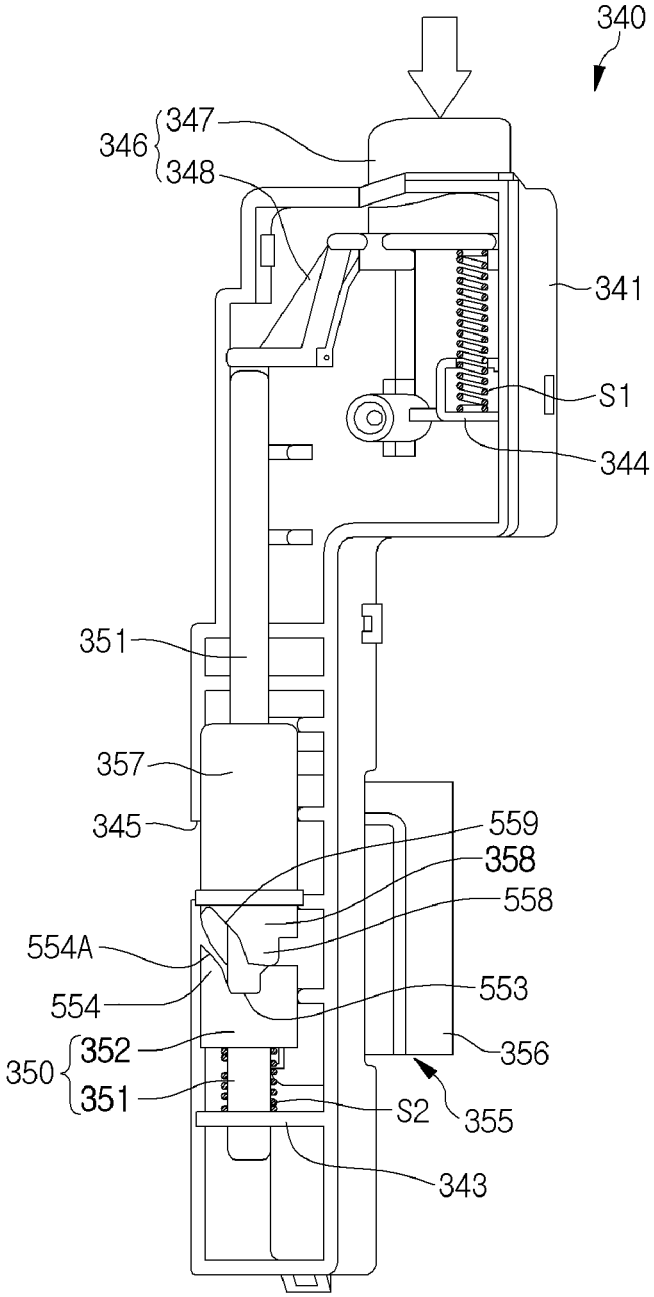
FIG. 14 is a view of a state in which the example first hinge assembly is unlocked.

FIG. 13 illustrates another example first hinge assembly, and FIG. 14 illustrates a state in which the example first hinge assembly is unlocked.

The example shown in FIGS. 13 and 14 is the same as the example shown in FIGS. 4 and 5 except for a structure of the first and second locking parts. Thus, the above description of the same parts is referenced, rather than repeated.

Referring to FIGS. 13 and 14, a first locking part 352 may be a portion having a diameter greater than that of a shaft body 351. The first locking part 352 may protrude from the whole circumferential surface of the shaft body 351 or radially protrude from a portion of the shaft body 351. The first locking part 352 may include a first locking groove 553 and a second locking projection 554. The second locking part 358 may include a first locking projection 558 inserted into the first locking groove 553 and a second locking groove 559 in which the second locking projection 554 is inserted.

The second locking projection 554 has a plurality of tilted surfaces 554A and 554B. The plurality of tilted surfaces 554A and 554B may be tilted so that the tilted surfaces 554A and 554B are gradually closer to the second locking groove 559. Thus, at least a portion of the second locking projection 554 may have a triangular shape. Accordingly, the second locking groove 559 may also have a plurality of tilted surfaces, and at least a portion of the second locking groove 559 may have a triangular shape.

At least a portion of a contact surface between the first locking groove 553 and the first locking projection 558 may be a horizontal plane.

When the rotation shaft 350 is pressed, the first locking projection 558 may be withdrawn from the first locking groove, and thus, the rotation shaft 350 together with the pillar 30 may be rotatable.

When rotation force is removed in a state where the pressed rotation shaft 350 is rotated within a predetermined angle, the rotation shaft 350 may be rotated in a direction in which the second locking projection 554 is inserted into the second locking groove 559 by the plurality of tilted surfaces 554A and 554B of the second locking projection 554, the plurality of tilted surfaces of the second locking groove 559, and a second elastic member S2. Thus, the pillar 30 may be maintained in a folded state without being spread.

That is, according to this example, when rotation force of the pillar 30 is removed in the state where the pillar 30 is not completely spread by the rotation force of the pillar 30, the pillar 30 may be return to its folded state by the first and second locking parts 352 and 358. Thus, the second locking projection 554 and the second locking groove 559 may be called a locking guide device for the pillar 30.

Although implementations have been described with reference to a number of illustrative examples thereof, numerous other modifications and implementations fall within the spirit and scope of the disclosure. More particularly, variations and modifications are possible in the component parts and/or arrangements and fall within the scope of the disclosure, the drawings, and the appended claims. In addition to variations and modifications in the component parts and/or arrangements, alternative uses also are contemplated.

What is claimed is:

1. A refrigerator comprising:

a main body having a refrigerating compartment and a freezing compartment disposed under the refrigerating compartment;

first and second refrigerating compartment doors configured to open or close the refrigerating compartment;

a freezing compartment door configured to open or close the freezing compartment;

a hinge body connected to the first refrigerating compartment door;

a pillar connected to the hinge body;

a locking device configured to restrict the pillar from rotating and maintain the pillar in a folded state based on the first door being oriented in an opened position; and an unlocking device configured to release the locking of the locking device and allow the pillar to rotate to a spread state based on the first door being closed.

2. The refrigerator according to claim 1, wherein the locking device is configured to maintain the pillar in the folded state based on a rotational force being applied to the pillar when the first door is oriented in the opened position.

3. The refrigerator according to claim 1, further comprising a rotation shaft that is configured to enable the pillar to rotate with respect to the hinge body.

4. The refrigerator according to claim 3, wherein the locking device is configured to restrict the hinge body and the rotation shaft from rotating with respect to each other.

5. The refrigerator according to claim 4, wherein the locking device comprises:

a first locking part disposed on the rotation shaft; and a second locking part disposed on the hinge body.

6. The refrigerator according to claim 5, wherein the hinge body comprises:

a coupling part coupled to the first door; and a shaft connection part disposed within the pillar and through which the rotation shaft passes, wherein the second locking part is disposed on the shaft connection part.

7. The refrigerator according to claim 5, wherein one of the first and second locking parts comprises a locking projection, and another of the first and second locking parts comprises a projection groove configured to receive the locking projection.

8. The refrigerator according to claim 7, wherein, based on the rotation shaft moving downward, the locking projection is configured to withdraw from the projection groove, thereby enabling rotation of the pillar.

9. The refrigerator according to claim 7, wherein the locking projection is a first locking projection, the projection groove is a first projection groove, the first locking part comprises the first locking projection, the second locking part comprises the first projection groove, the second locking part comprises a second locking projection, and the first locking part comprises a second projection groove configured to receive the second locking projection.

10. The refrigerator according to claim 5, further comprising an elastic member that is configured to elastically support the first locking part in a manner that maintains a locked state of the first and second locking parts.

11. The refrigerator according to claim 4, further comprising a holder disposed on the refrigerating compartment and configured to guide rotation of the pillar, wherein the unlocking device comprises:

an operator disposed within the pillar and configured to move in a direction that presses the rotation shaft; and a push part disposed on the holder and configured to press the operator based on the first door being closed.

12. The refrigerator according to claim 11, wherein the operator is separated from the rotation shaft.

13. The refrigerator according to claim 11, wherein the operator is integrated with the rotation shaft.

14. The refrigerator according to claim 11, wherein the operator comprises:

a protrusion that protrudes outside of the pillar; and a press part that extends from the protrusion and is configured to press the rotation shaft.

15. The refrigerator according to claim 14, wherein the protrusion comprises a tilted surface, the holder comprises an accommodation space configured to accommodate the protrusion, and the push part is disposed in the accommodation space.

16. The refrigerator according to claim 15, wherein the accommodation space comprises a first accommodation space in which the protrusion is accommodated based on the first door being open and a second accommodation space bent from the first accommodation space, based on the first door being closed, the protrusion is accommodated into the second accommodation space via the first accommodation space, and in a state in which the protrusion is disposed in the first accommodation space, the operator is configured to press the rotation shaft to release the locking of the locking device.

17. The refrigerator according to claim 11, further comprising an elastic member that is configured to elastically support the operator.

* * * * *